US008670984B2

(12) United States Patent
Dow et al.

(10) Patent No.: US 8,670,984 B2
(45) Date of Patent: Mar. 11, 2014

(54) AUTOMATICALLY GENERATING AUDIBLE REPRESENTATIONS OF DATA CONTENT BASED ON USER PREFERENCES

(75) Inventors: Eli M. Dow, Poughkeepsie, NY (US); Marie R. Laser, Poughkeepsie, NY (US); Sarah J. Sheppard, Poughkeepsie, NY (US); Jessie Yu, Wappingers Falls, NY (US)

(73) Assignee: Nuance Communications, Inc., Burlington, MA (US)

( * ) Notice: Subject to any disclaimer, the term of this patent is extended or adjusted under 35 U.S.C. 154(b) by 231 days.

(21) Appl. No.: 13/034,774

(22) Filed: Feb. 25, 2011

(65) Prior Publication Data

US 2012/0221338 A1 Aug. 30, 2012

(51) Int. Cl.
*G10L 13/00* (2006.01)

(52) U.S. Cl.
USPC ..... 704/260; 704/258; 704/270

(58) Field of Classification Search
USPC ..... 704/258, 260, 270–271
See application file for complete search history.

(56) References Cited

U.S. PATENT DOCUMENTS

| | | | | |
|---|---|---|---|---|
| 6,609,096 | B1 * | 8/2003 | De Bonet et al. | 704/500 |
| 8,009,814 | B2 * | 8/2011 | Hewitt et al. | 379/88.23 |
| 8,103,554 | B2 * | 1/2012 | Tom | 705/26.1 |
| 2004/0003097 | A1 * | 1/2004 | Willis et al. | 709/228 |
| 2004/0111467 | A1 * | 6/2004 | Willis | 709/203 |
| 2006/0265409 | A1 * | 11/2006 | Neumann et al. | 707/100 |
| 2007/0078655 | A1 | 4/2007 | Semkow et al. | |
| 2007/0106760 | A1 * | 5/2007 | Houh et al. | 709/219 |
| 2007/0214485 | A1 * | 9/2007 | Bodin et al. | 725/101 |
| 2007/0250321 | A1 * | 10/2007 | Balusu | 704/260 |
| 2007/0271222 | A1 * | 11/2007 | Fu | 707/2 |
| 2008/0030797 | A1 * | 2/2008 | Circlaeys et al. | 358/448 |
| 2008/0140387 | A1 * | 6/2008 | Linker | 704/9 |
| 2009/0319273 | A1 * | 12/2009 | Mitsui et al. | 704/260 |
| 2010/0241963 | A1 * | 9/2010 | Kulis et al. | 715/727 |
| 2010/0318365 | A1 * | 12/2010 | Yuen et al. | 704/270 |
| 2010/0332596 | A1 * | 12/2010 | Perrella et al. | 709/203 |
| 2011/0161085 | A1 * | 6/2011 | Boda et al. | 704/260 |
| 2011/0276866 | A1 * | 11/2011 | Harrington | 715/209 |
| 2012/0072843 | A1 * | 3/2012 | Durham et al. | 715/733 |
| 2012/0158448 | A1 * | 6/2012 | Perrella et al. | 705/7.19 |

* cited by examiner

*Primary Examiner* — Douglas Godbold
(74) *Attorney, Agent, or Firm* — Holland & Knight LLP; Mark H. Whittenberger, Esq.

(57) ABSTRACT

A custom-content audible representation of selected data content is automatically created for a user. The content is based on content preferences of the user (e.g., one or more web browsing histories). The content is aggregated, converted using text-to-speech technology, and adapted to fit in a desired length selected for the personalized audible representation. The length of the audible representation may be custom for the user, and may be determined based on the amount of time the user is typically traveling.

14 Claims, 6 Drawing Sheets

AUTOMATICALLY GENERATING AUDIBLE REPRESENTATIONS OF DATA CONTENT BASED ON USER PREFERENCES

BACKGROUND

This invention relates, in general, to text-to-speech conversion, and in particular, to generating audible representations of data content.

Often, people desire additional time to read news stories or other selected information obtained from the internet, e-mail or elsewhere. In addition, these same people may spend a good deal of time commuting to work or otherwise traveling in a vehicle, such as a car, bus, train, plane, etc. It would thus be beneficial to have an efficient way to obtain the information that they are interested in while commuting or traveling. This is particularly true in those situations in which the user is not able to read the information while traveling, such as while driving a motor vehicle.

BRIEF SUMMARY

The shortcomings of the prior art are overcome and additional advantages are provided through the provision of a computer program product for generating audible representations of data content. The computer program product includes, for instance, a computer readable storage medium readable by a processing circuit and storing instructions for execution by the processing circuit for performing a method. The method includes, for instance, automatically determining content to be included in an audible representation of data content to be generated for a particular user, the automatically determining automatically selecting the content for the particular user based on a history of content preferences for the particular user; and generating the audible representation for the particular user using the selected content, wherein a custom-content audible representation is generated for the particular user.

Systems and methods relating to one or more aspects of the present invention are also described and claimed herein. Further, services relating to one or more aspects of the present invention are also described and may be claimed herein.

Additional features and advantages are realized through the techniques of the present invention. Other embodiments and aspects of the invention are described in detail herein and are considered a part of the claimed invention.

BRIEF DESCRIPTION OF THE SEVERAL VIEWS OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

In accordance with an aspect of the present invention, a custom-content audible representation of selected data content is automatically created for a user. As an example, the content is based on the user's history of content preferences, such as based on one or more web browsing histories, including, for instance, those web sites and/or broadcast email accessed by the user. The content is aggregated, converted using text-to-speech technology, and adapted to fit in a desired length selected for the personalized audible representation. In one example, the length of the audible representation is custom for the user, and determined based on, for instance, the amount of time the user is typically traveling (e.g., commuting to/from work).

In a further embodiment, the amount of speech content included in a particular audible representation depends on the amount of storage available for the audible representation. For instance, in one example, if there is fixed storage on the device used to play the audible representation, then the generated audible representation may be smaller than the pre-calculated duration of travel and/or smaller in data size than the remaining capacity of the device (or whichever is less). That is, the size of the audible representation may be adjusted to fit the amount of available storage. If the device used for playback during travel (e.g., iPod, cell phone, car computer, etc.) has network transmission capabilities, the data could be streamed from some external device (e.g., computer) holding the audible representation.

The audible representation may be downloaded (or streamed if remote storage and connectivity are available) to a device that can play it back, such as the user's iPod, cell phone, computer or a disc to be played in a car stereo or other type device. In a further example, it can be transmitted over Bluetooth (or other short distance wireless transmission media) from the user's computing device to a car stereo. Alternatively, a user could call a certain number to have the audible representation played over their mobile phone or any device capable of making calls. Each user could have a unique number to call to automatically get their latest up-to-date information. Many other examples exist.

Figure 1:
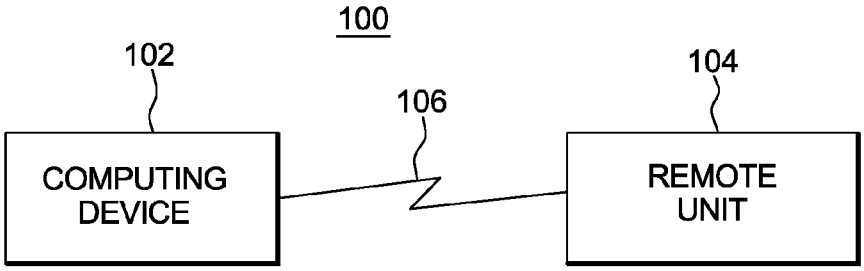
FIG. 1 depicts one example of a computing environment to incorporate and/or use one or more aspects of the present invention.

One embodiment of a computing environment used to create custom-length, custom-content audible representations is described with reference to FIG. 1. As shown, a computing environment 100 includes a computing device 102 coupled to a remote unit 104 via, for instance, a connection 106, such as an internet, intranet, or other type of network connection. As examples, computing device 102 includes a laptop, other type of computer, mobile device (e.g., cell phone) or any other type of computing device that can be used to access data from remote unit 104. In one example, it includes at least one central processing unit (a.k.a., processor), memory, and one or more input/output devices/interfaces, coupled to one another via one or more buses. Remote unit 104 includes any type of unit(s) that can provide textual information from a variety of sources, such as the world-wide web, e-mail, etc. For instance, it can be a group of one or more computers or other types of computing devices.

A user uses computing device 102 to access remote unit 104 to access one or more data sources having content in which the user is interested. This content is then aggregated and converted to speech to provide an audible representation for use by the user. In one particular example, the user listens to the audible representation while traveling to/from work, and thus, the audible representation is tailored to fit within the user's commute time. The audible representation is created at predetermined times, such as daily, prior to leaving for work, and/or prior to returning home from work, etc.

One embodiment of an overview of the logic to create an audible representation is described with reference to FIG. 2. In this example, the audible representation is a custom-length, custom-content audible representation designed for a particular user. In one example, this logic is performed by a processor executing on computing device 102, or another processor coupled to computing environment 100.

Figure 2:
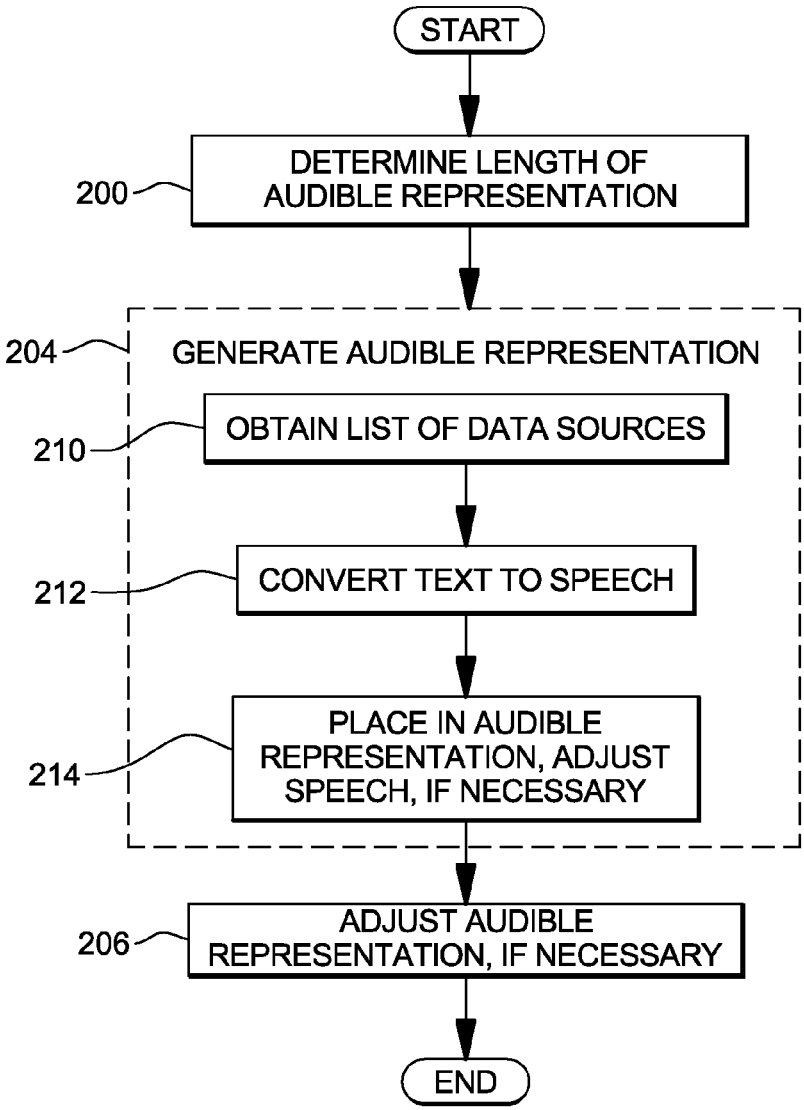
FIG. 2 depicts one embodiment of an overview of the logic to generate a custom-length, custom-content audible representation of selected data content, in accordance with an aspect of the present invention.

Referring to FIG. 2, initially, in one example, the length of the audible representation to be created is determined, STEP 200. As described herein, the length of the audible representation is custom for the particular user. As examples, the length may be provided by the user or automatically determined for the user, as described below. Subsequent to determining the desired length of the audible representation, the audible representation is generated, STEP 204, and any adjustments, if necessary or desired, are made to the audible representation, STEP 206. In one example, the generating of the audible representation includes obtaining a list of data sources from which text content is to be obtained, STEP 210; converting the text content to speech content, STEP 212; and placing the speech content in the audible representation, including adjusting the speech content, if necessary, to fit within the determined length, STEP 214. Each of these steps is described in further detail below.

One embodiment of the logic for determining the length of the audible representation is described with reference to FIG. 3. The logic determines, for instance, whether the length is for round-trip or one-way travel. As an example, a processor executing on a device, such as computing device 102, performs this logic.

Figure 3:
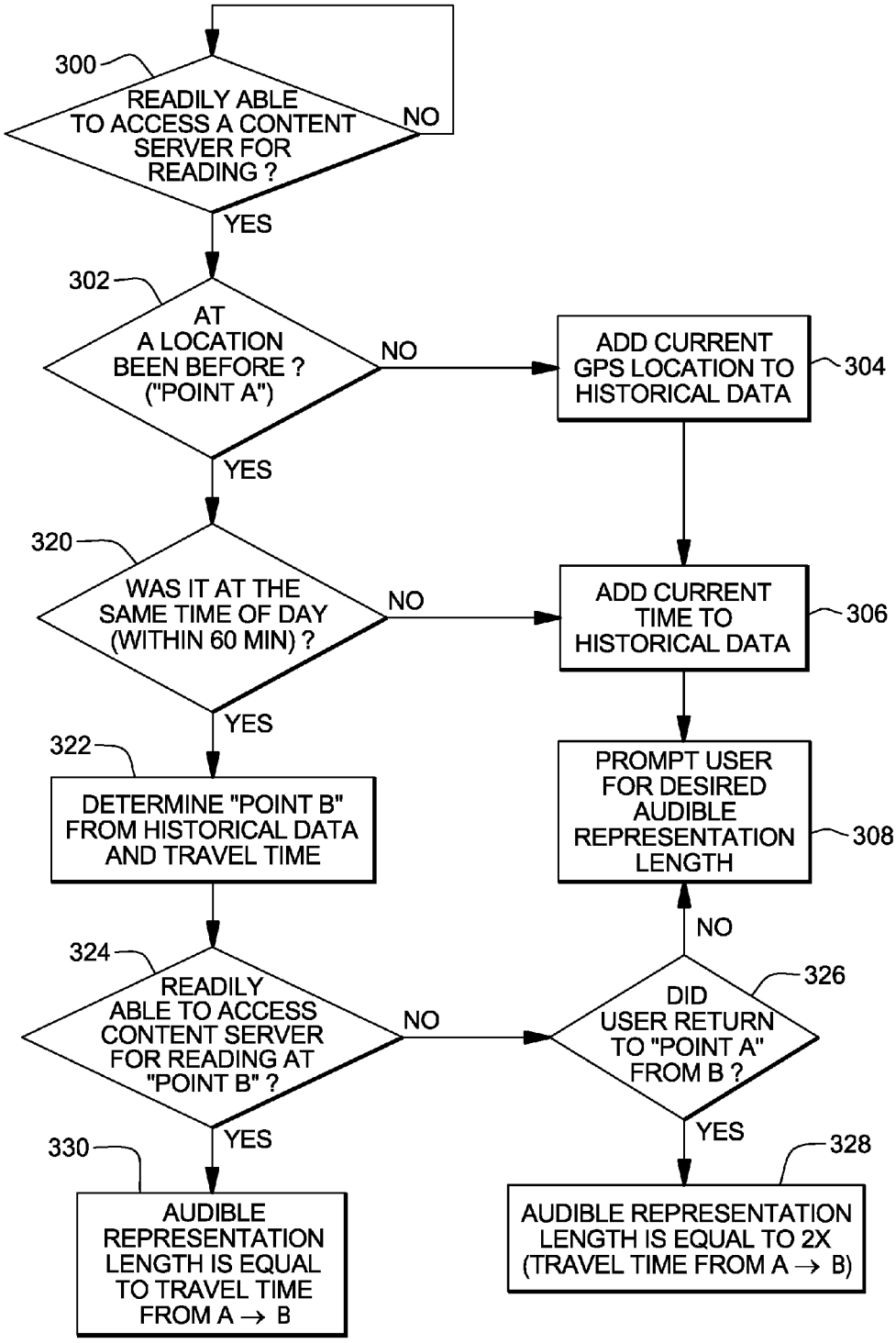
FIG. 3 depicts one embodiment of the logic to determine the length of the audible representation, in accordance with an aspect of the present invention.

Referring to FIG. 3, initially, a determination is made as to whether the user is at a location and has access to a computing device, in which the user is able to access a content server for reading data content (e.g., at home using a personal computer, workstation, laptop or any other device), and thus, does not need to listen to the audible representation (instead can read the information), INQUIRY 300. That is, if the user is, for instance, at home and not traveling, and therefore, can read the information, instead of listen to it, it is said that the user is readily able to access a content server for reading. If the user is readily able to access the content server and read the desired information, then processing continues with determining the custom length. Otherwise, processing waits for such a situation, INQUIRY 300, or terminates.

If it is determined that the user is at a location in which the user can readily access a content server to read the information, a determination is made as to whether the user has been at this location before (referred to as Point A), INQUIRY 302. This determination is based on saved historical data, as an example. If the user has not been at this location before, then information relating to the current location is added to the historical data, STEP 304. For instance, the location information obtained from the Global Positioning System (GPS) installed in the user's device is added to the current historical data (or the user inputs current location information). Further, the current time is added to the historical data, STEP 306. Additionally, since the user has not been at this location before, in one example, the length of the audible representation is not determined automatically, but instead, the user is prompted for the desired length of the audible representation, STEP 308. In a further example, the processor automatically selects a length for the user and the user is not prompted for a desired audible representation length.

Returning to INQUIRY 302, if the user is at a location that the user has been before, then a determination is made as to whether it was at the same time of day, INQUIRY 320. In one example, this determination is made by looking at the historical data to determine the time(s) at which the user was at this location. In this example, it is determined to be at the same time of day if it is within 60 minutes of the other time. (In other examples, other amounts of time may be chosen.) If it was not at the same time of day, then the current time is added to the historical data, STEP 306, and processing proceeds as described above. (In a further example, INQUIRY 320 may be omitted.)

Returning to INQUIRY 320, if it was the same time of day, a determination of another location to which the user may travel (referred to as Point B) is made from the historical data and travel time, STEP 322. That is, after the user travels to another destination (as determined by GPS information, logging onto a computing device, input, etc.), the amount of travel time it took to arrive at the next location and/or historical data is used to determine Point B (e.g., now at work, instead of home). (Point B may also be determined in other ways, including by input.)

Further, a determination is made as to whether the user is readily able to access a content server for reading at Point B, INQUIRY 324. If not, then a determination is made as to whether the user has previously returned to Point A from Point B, INQUIRY 326. This is determined based on, for instance, historical GPS data and/or other historical data. If the user did not return to Point A from Point B in the past, then the user is prompted for a desired audible representation length in this example, STEP 308 (or a length of time is automatically selected for the user). However, if the user did return to Point A from Point B in the past, then the audible representation length is set equal to two times the travel time from A to B, STEP 328. That is, the audible representation length is automatically determined to be the roundtrip commute time from Point A to Point B.

Returning to INQUIRY 324, if the user is readily able to access a content server for reading at Point B, then the audible representation length is set equal to the travel time from A to B, STEP 330. Another audible representation can then be created for B to A. This completes one embodiment of the logic to determine the audible representation length.

In another embodiment, the length is automatically determined by obtaining a start address for Point A and an ending address for Point B, and using mapping software, such as Google maps, Mapquest, etc., to determine the amount of time to travel between Point A and Point B. That time is then used to define the length of the audible representation. As examples, the exact amount of time it takes to travel between the two points may be used or the time may be adjusted by a factor (e.g., + or −5 minutes or some other desired time). The length may be for one-way travel or round-trip travel depending on user preference, which is input, or automatically determined based on, for instance, whether another audible representation can be created for the return trip, as described above. Further, the start and ending addresses may be input or automatically obtained from GPS data (e.g., from a portable GPS device or a GPS device installed in the car, the user's mobile device, laptop, etc.). Further, the user can also explicitly save or set the user's current location as Point A and/or Point B. Other examples are also possible.

In addition to determining the length of the audible representation, a list of the data sources for use in generating the custom-content audible representation is obtained. One embodiment of this logic is described with reference to FIG. 4. This logic is performed by, for instance, a processor of the computing device or another processor coupled to computing environment 100.

Figure 4:
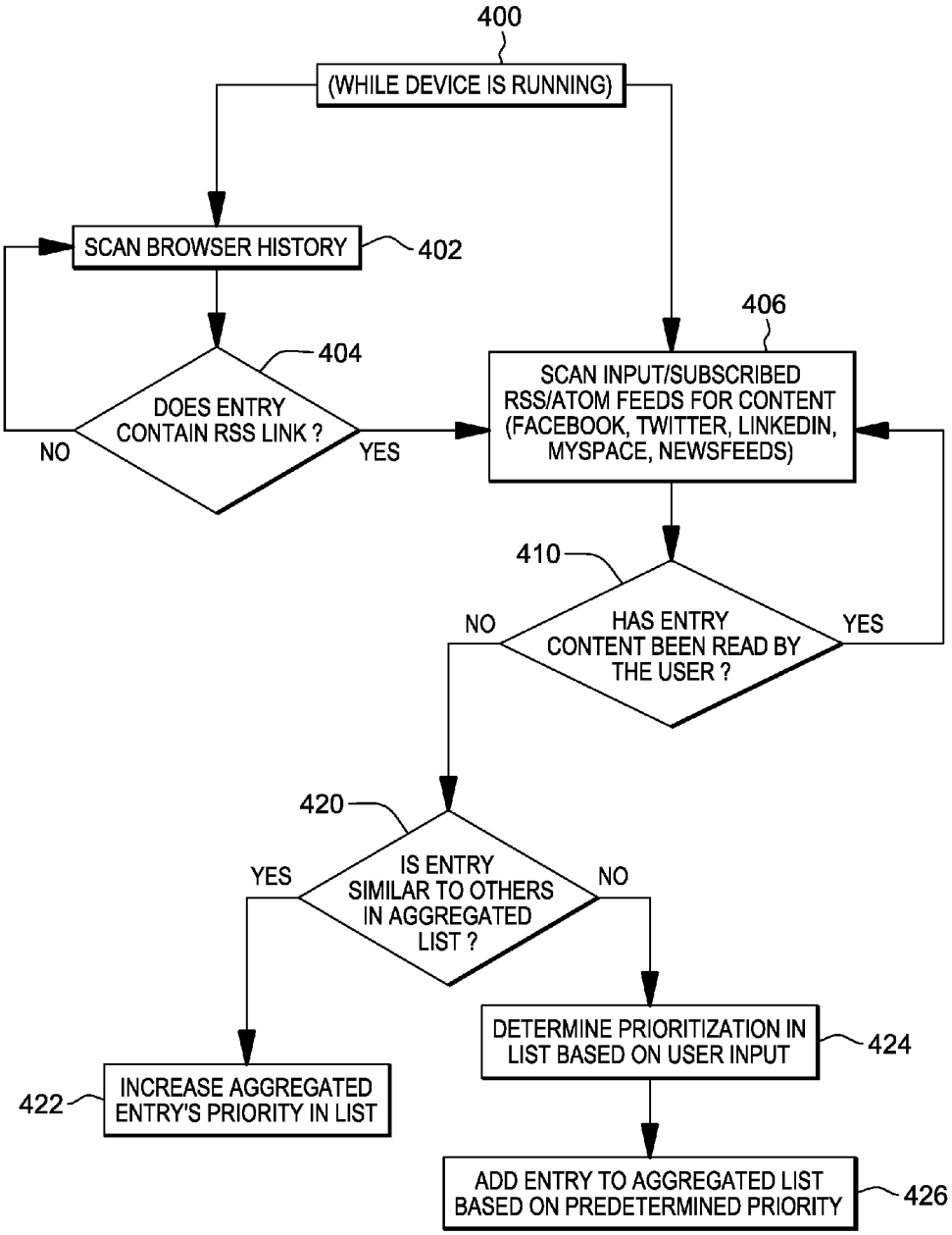
FIG. 4 depicts one example of the logic to determine a list of sources to provide content for the audible representation, in accordance with an aspect of the present invention.

Referring to FIG. 4, initially, while the user's device (e.g., computing device 102) is running, STEP 400, the user's browser history is scanned, STEP 402. This may be the browser history on the device running and/or a synchronization of browser histories of the user (e.g., from multiple computers, mobile devices, etc. of the user). The synchronization of the multiple browser histories may be provided by any number of free online utilities, an example of which is rsync.

In one example, in the background while the user's computer, laptop, cell phone or other device is running, its browser history (or a synchronized history) is scanned by a daemon to determine whether any of the entries of the browser history include direct or indirect references to an RSS (Really Simple Syndication) link, INQUIRY 404. This determination is made using a standard query for RSS feeds. If the browser history entry does not include an RSS link, then the browser history continues to be scanned. Further, the browser history entry is reloaded in a background process, and the content is compared to previous views of that page. The changes or deltas in textual content are added as material for audible representation generation.

If an entry of the browser history has an RSS link, then processing continues with scanning the push feeds for content, STEP 406. These feeds include, for instance, input/subscribed RSS/ATOM feeds or other subscription style services that are altered asynchronously for new content, including, for instance, facebook, twitter, linkedin, mySpace and newsfeeds. This step may also be directly input from STEP 400.

A determination is made as to whether the entry content has been read by the user, INQUIRY 410. This determination is made, for instance, by the amount of time that the user spent at the source of that entry. If the user spent a predetermined amount of time (e.g., at least 15 seconds), then it is determined that the content has been read, and therefore, it does not need to be included in the audible representation. Thus, processing continues with STEP 406. However, if the entry has not been read, then a determination is made as to whether the entry is similar to others in an aggregated list of entries, INQUIRY 420. That is, a list of content entries is maintained, and that list is checked to see if the incoming entry is similar to one already in the list (e.g., similar or same title, key words, etc.). If so, a priority associated with the entry already in the list is increased, STEP 422 (and this entry is not added to the list to avoid duplication). This priority may be explicit, such as a priority number assigned to each entry or implicit based on location in the list. For instance, entries at the top of the list have a higher priority than entries lower in the list.

Returning to INQUIRY 420, if an entry is not similar to others in the aggregated list, then prioritization of the entry is determined based on, for instance, user input, STEP 424. The entry is then added to the aggregated list based on the priority, STEP 426. This concludes the processing for determining a list of data sources for providing content for the audible representation.

Subsequent to determining the data sources, the data content is obtained from those sources (e.g., downloaded), and the data content, which is in text format, is converted to speech format. The conversion is performed by a text-to-speech converter. Example products that convert text to speech include, for instance, ViaVoice by International Business Machines Corporation, Armonk, N.Y.; NaturalReader by NaturalSoft LTD., Richmond, BC, Canada; FlameReader by FlameSoft Technologies, Inc., Vancouver, BC, Canada; Natural Voices by AT&T Labs, Inc., NJ, USA; and gnuspeech offered by Free Software Foundation, Boston, Mass.

The converted speech content is then used to generate the audible representation. This is described in further detail with reference to FIG. 5, in which one embodiment of adjusting the speech content to fit in the custom-defined length for the audible representation is described. This logic is performed by the processor of computing device 102 or another processor coupled to computing environment 100.

Figure 5:
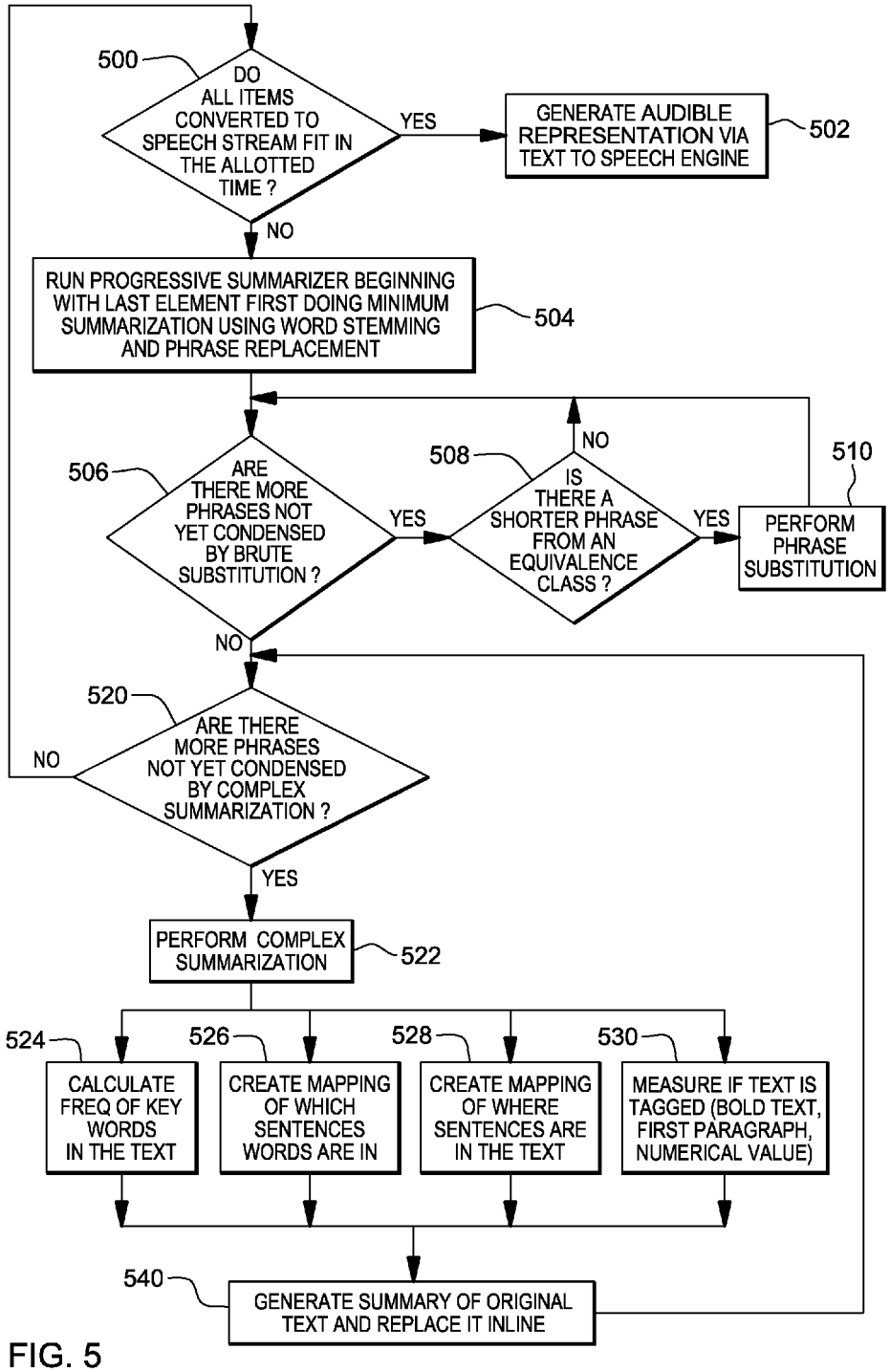
FIG. 5 depicts one example of the logic to adjust the content to fit into the allotted time for the audible representation, in accordance with an aspect of the present invention.

Referring to FIG. 5, initially, a determination is made as to whether all items converted to speech fit in the allotted time that was determined for the audible representation, INQUIRY 500. If so, then the audible representation is generated via a text to speech engine, STEP 502. As examples, the text to speech products described above include such engines.

However, if all the items converted to speech do not fit in the allotted time, then a progressive summarizer is run to adjust the length of the speech stream, such that it fits within the custom-defined time, STEP 504. In one example, the progressive summarizer begins with the last element, since, in this example, this is of a lower priority (i.e., e.g., the content list is in priority order with the highest priority at top). The summarizer first performs minimum summarization using word stemming and phrase replacement. This includes, for instance, removing adverbs and/or suffixes, replacing phrases with equivalent shorter phrases, and/or longer words with shorter words. As an example, initially, a determination is made as to whether there are phrases to be condensed by brute substitution, INQUIRY 506. If so, a phrase is selected and a determination is made as to whether there is a shorter phrase for the selected phrase that may be chosen from an equivalence class, INQUIRY 508. If not, processing continues with INQUIRY 506. Otherwise, phrase substitution is performed, STEP 510, and processing continues with INQUIRY 506.

At INQUIRY 506, if there are no more phrases to be condensed by brute substitution, then a further determination is made as to whether there are phrases to be condensed by complex summarization, INQUIRY 520. (In a further embodiment, complex summarization is performed after determining that the speech resulting from the minimum summarization still does not fit in the allotted time. Further, minimum summarization may not be performed for all phrases, if after minimizing one or more phrases the converted speech fits in the allotted time.) If there are no phrases to be condensed by complex summarization, then processing continues with INQUIRY 500. Otherwise, complex summarization is performed, STEP 522. This includes, for instance, calculating the frequency of key words in the text, STEP 524; creating a mapping of which sentences words are in, STEP 526; creating a mapping of where sentences are in the text, STEP 528; and measuring if the text is tagged (e.g., bold text, first paragraph, numbered value, etc.), STEP 530. This measurement is performed by, for instance, reviewing tag lines in the text (e.g., html text). Using these calculations and mappings, a summary of original text is generated and replaced in line, STEP 540. In one example, this summary is performed using a summarization tool, examples of which are described below. Processing then continues with INQUIRY 520.

Progressive summarization and/or complex summarization may be run multiple times if the resulting speech, after summarization, still does not fit in the allotted time. The summarization is progressive in the sense that it is performed one or more times, but if an absolute minimum is reached (as determined by running the summarization engine on a body of text two consecutive times and achieving no change), then prioritization ranking of the source material is performed, in which lower priority text segments (like from a news website only read occasionally) is removed in favor of higher priority input text sources.

As indicated above, there are tools for performing complex summarization, as well as minimum summarization. These tools include the Open Text Summarizer, which is an open source tool; and Classifier4J, which is a Java library designed to perform text summarization, as examples. Further, text summarization is described in *Advances in Automatic Text Summarization,* by Inderjeet Mani, Mark T. Mayburg, The MIT Presss, 1999.

Subsequent to adjusting the speech so that it fits within the allotted time, the audible representation is generated using a text to speech engine. Thereafter, the audible representation may be downloaded to a listening device, such as an iPod, placed on a compact disc or other medium for use in a compact disc player or other machine, or otherwise transmitted to the user for listening.

The audible representation is custom designed for the user, and as such, in one embodiment, user feedback of the audible representation is recorded in order to improve on the next audible representation created for the user. One embodiment of this logic is described with reference to FIG. 6. This logic is performed by a processor either on or coupled to the device that is playing the audible representation.

Figure 6:
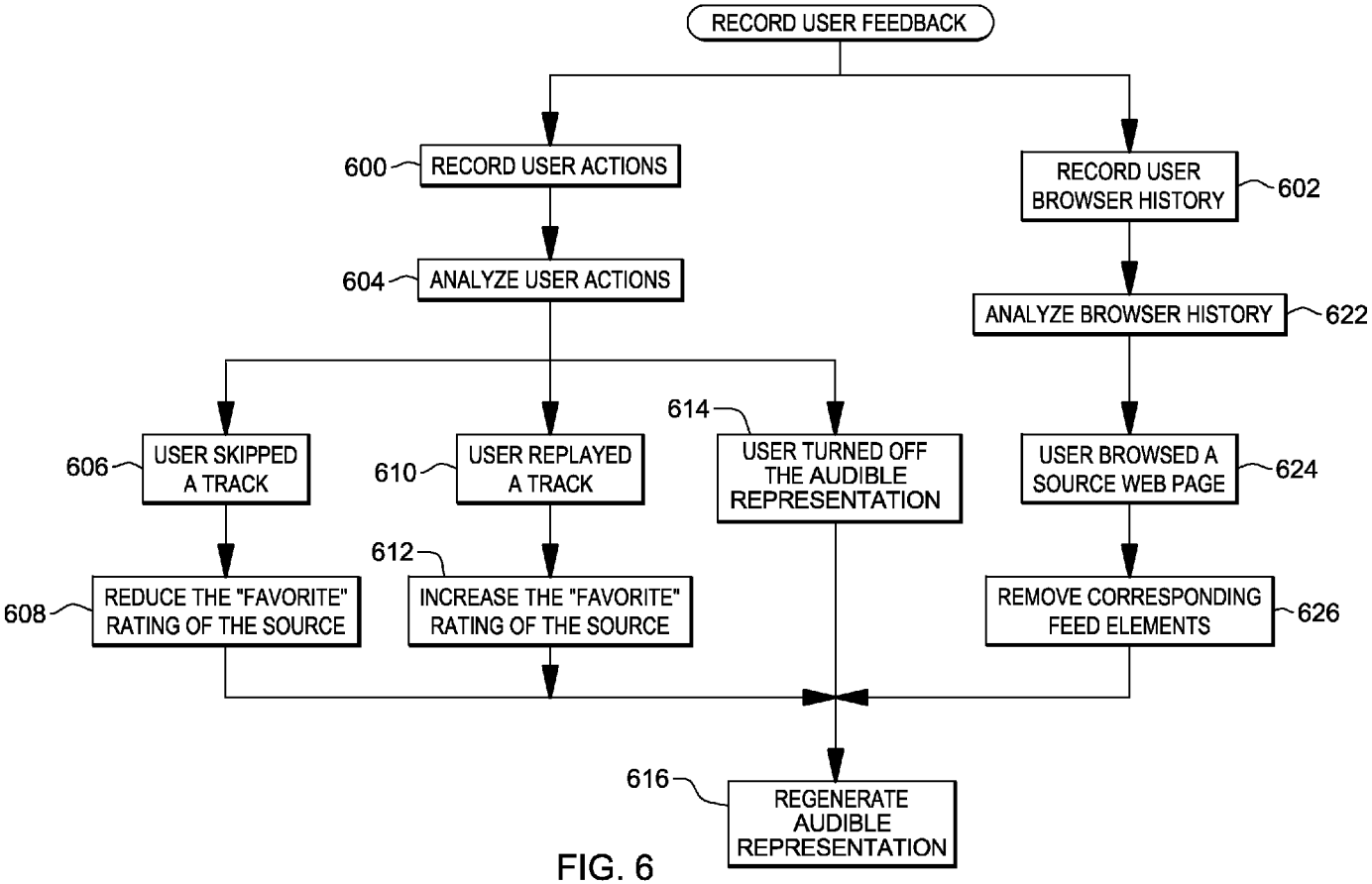
FIG. 6 depicts one example of the logic to adjust the audible representation, in accordance with an aspect of the present invention.

Referring to FIG. 6, in one embodiment, to record the user's feedback, actions of the user are recorded, STEP 600, as well as the user's browser history, STEP 602. For instance, a record is maintained of whether the user skipped a track or replayed a track, STEP 600. Those actions are then analyzed, STEP 604. For instance, if the user skipped a track, STEP 606, then the favorite rating of the source is reduced, STEP 608. Likewise, if the user replayed a track, STEP 610, then the favorite rating of the source is increased, STEP 612. After reducing or increasing the favorite rating or if the user turned off the audible representation, STEP 614, the audible representation may be regenerated to reflect the user actions, STEP 616. Thus, any sources with increased ratings will now be played earlier in the audible representation and may include more of its content, if size is an issue.

In addition to recording user actions, the user's browser history is recorded, STEP 602, and analyzed, STEP 622. The browser histories from multiple user devices (e.g., laptop, cell phone, etc.) may be recorded and then analyzed. The information may be synchronized using, for instance, an online rsync utility. The analysis includes, for instance, determining that the user browsed a particular source web page, and thus, should be added to the audible representation, STEP 624, and/or removing feed elements that the user is no longer interested in, STEP 626. Processing then continues with regenerating the audible representation to include the additional/different material, STEP 616. The regenerating is performed as described above with generating the audible representation. As examples, the audible representation is regenerated responsive to changes and/or at predefined times, such as daily.

Described in detail above is a capability for creating a custom-length, custom-content audible representation for a user. The audible representation is custom designed for the particular user based on the type of content the user enjoys reading and the amount of time the user is commuting or otherwise wishes to listen to an audible representation. In one example, the user's usage pattern (e.g., web history of a user) is used to generate the personalized audible representation. Further, the audible representation that is generated accommodates a custom length defined for the user. This custom length is, for instance, based on the user's commute time. In one embodiment, redundant information is removed from the audible representation.

In one example, the collection of sources for the audible representation is performed in the background during the day or night, such that at any time when the user opts to shutdown or suspend their device, the audible representation has already been created and will not delay shutdown time. Thus, data collection may be spooled so that audible representations can be created from the initial data sources even if later data sources have not yet been converted.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system". Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable signal medium may include a propagated data signal with computer readable program code embodied therein, for example, in baseband or as part of a carrier wave. Such a propagated signal may take any of a variety of forms, including, but not limited to, electromagnetic, optical or any suitable combination thereof. A computer readable signal medium may be any computer readable medium that is not a computer readable storage medium and that can communicate, propagate, or transport a program for use by or in connection with an instruction execution system, apparatus or device.

A computer readable storage medium may be, for example, but not limited to, an electronic, magnetic, optical, electromagnetic, infrared or semiconductor system, apparatus, or device, or any suitable combination of the foregoing. More specific examples (a non-exhaustive list) of the computer readable storage medium include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

Figure 7:
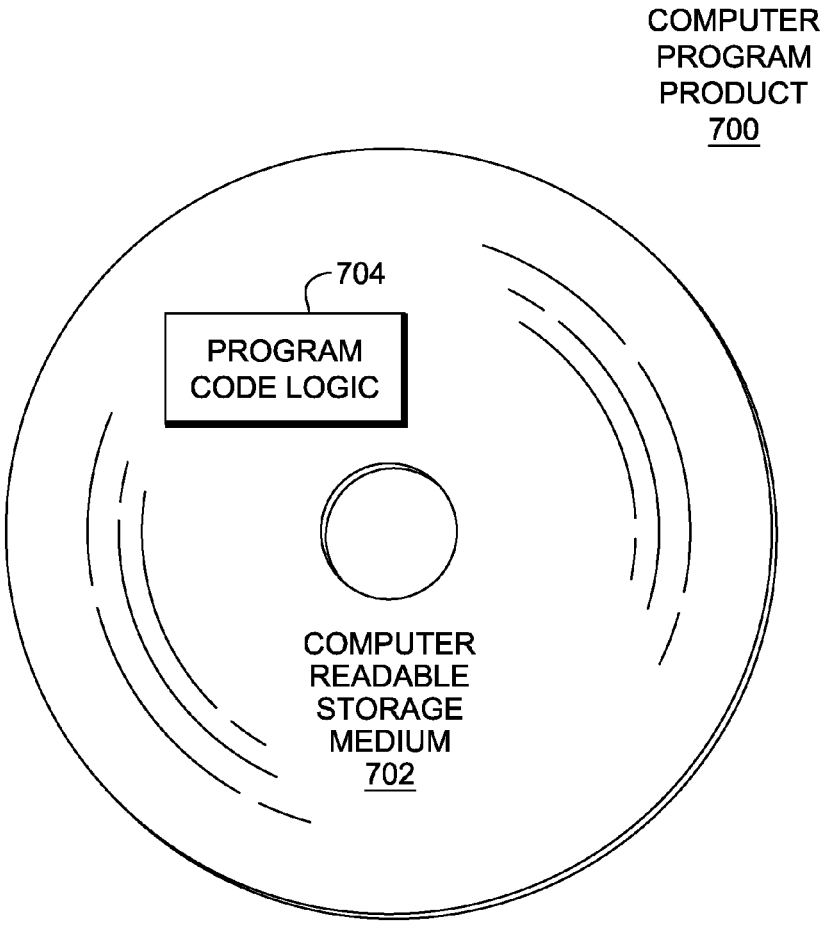
FIG. 7 depicts one embodiment of a computer program product incorporating one or more aspects of the present invention.

Referring now to FIG. 7, in one example, a computer program product 700 includes, for instance, one or more tangible, non-transitory computer readable storage media

702 to store computer readable program code means or logic 704 thereon to provide and facilitate one or more aspects of the present invention.

Program code embodied on a computer readable medium may be transmitted using an appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language, such as Java, Smalltalk, C++ or the like, and conventional procedural programming languages, such as the "C" programming language, assembler or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described herein with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

In addition to the above, one or more aspects of the present invention may be provided, offered, deployed, managed, serviced, etc. by a service provider who offers management of customer environments. For instance, the service provider can create, maintain, support, etc. computer code and/or a computer infrastructure that performs one or more aspects of the present invention for one or more customers. In return, the service provider may receive payment from the customer under a subscription and/or fee agreement, as examples. Additionally or alternatively, the service provider may receive payment from the sale of advertising content to one or more third parties.

In one aspect of the present invention, an application may be deployed for performing one or more aspects of the present invention. As one example, the deploying of an application comprises providing computer infrastructure operable to perform one or more aspects of the present invention.

As a further aspect of the present invention, a computing infrastructure may be deployed comprising integrating computer readable code into a computing system, in which the code in combination with the computing system is capable of performing one or more aspects of the present invention.

As yet a further aspect of the present invention, a process for integrating computing infrastructure comprising integrating computer readable code into a computer system may be provided. The computer system comprises a computer readable medium, in which the computer medium comprises one or more aspects of the present invention. The code in combination with the computer system is capable of performing one or more aspects of the present invention.

Although various embodiments are described above, these are only examples. For example, other computing environments and/or devices can incorporate and use one or more aspects of the present invention. Additionally, other techniques for automatically determining length may be used, as well as other text-to-speech products, etc. Many variations are possible without departing from the spirit of the present invention.

Further, other types of computing environments can benefit from one or more aspects of the present invention. As an example, an environment may include an emulator (e.g., software or other emulation mechanisms), in which a particular architecture (including, for instance, instruction execution, architected functions, such as address translation, and architected registers) or a subset thereof is emulated (e.g., on a native computer system having a processor and memory). In such an environment, one or more emulation functions of the emulator can implement one or more aspects of the present invention, even though a computer executing the emulator may have a different architecture than the capabilities being emulated. As one example, in emulation mode, the specific instruction or operation being emulated is decoded, and an appropriate emulation function is built to implement the individual instruction or operation.

In an emulation environment, a host computer includes, for instance, a memory to store instructions and data; an instruction fetch unit to fetch instructions from memory and to optionally, provide local buffering for the fetched instruction; an instruction decode unit to receive the fetched instructions and to determine the type of instructions that have been fetched; and an instruction execution unit to execute the instructions. Execution may include loading data into a register from memory; storing data back to memory from a register; or performing some type of arithmetic or logical operation, as determined by the decode unit. In one example, each unit is implemented in software. For instance, the operations being performed by the units are implemented as one or more subroutines within emulator software.

Further, a data processing system suitable for storing and/or executing program code is usable that includes at least one processor coupled directly or indirectly to memory elements through a system bus. The memory elements include, for instance, local memory employed during actual execution of the program code, bulk storage, and cache memory which provide temporary storage of at least some program code in order to reduce the number of times code must be retrieved from bulk storage during execution.

Input/Output or I/O devices (including, but not limited to, keyboards, displays, pointing devices, DASD, tape, CDs, DVDs, thumb drives and other memory media, etc.) can be coupled to the system either directly or through intervening I/O controllers. Network adapters may also be coupled to the system to enable the data processing system to become coupled to other data processing systems or remote printers or storage devices through intervening private or public networks. Modems, cable modems, and Ethernet cards are just a few of the available types of network adapters.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components and/or groups thereof.

The corresponding structures, materials, acts, and equivalents of all means or step plus function elements in the claims below, if any, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiment with various modifications as are suited to the particular use contemplated.

What is claimed is:

1. A computer program product for generating audible representations of data content, said computer program product comprising:

a computer readable storage medium readable by a processing circuit and storing instructions for execution by the processing circuit for performing a method comprising:

automatically determining content to be included in an audible representation of data content to be generated for a particular user, the automatically determining including automatically selecting the content for the particular user based on a history of content preferences for the particular user and not based on content preferences of other users;

generating the audible representation for the particular user using the selected content, wherein a custom-content audible representation is generated for the particular user; and determining a custom-length for the audible representation, wherein the generating comprises tailoring the audible representation to the custom-length, wherein determining the custom-length comprises automatically determining the custom-length for the audible representation and wherein the automatically determining the custom-length comprises determining the custom-length based on a travel time for the particular user.

2. The computer program product of claim 1, wherein the history of content preferences comprises one or more browser histories of the particular user.

3. The computer program product of claim 1, wherein the method further comprises automatically determining the commute time of the particular user.

4. The computer program product of claim 1, wherein the automatically determining content to be included in the audible representation comprises prioritizing the selected content, and initially choosing content of a highest priority to be included in the audible representation.

5. The computer program product of claim 4, wherein the prioritizing assigns a higher priority to content that is included in the history from more than one source.

6. The computer program product of claim 1, wherein the generating comprises removing redundant content in generating the audible representation.

7. The computer program product of claim 1, wherein the method further comprises:

automatically determining one or more changes to be made to the audible representation; and regenerating the audible representation to reflect the one or more changes.

8. A computer system for generating audible representations of data content, said computer system comprising:

a memory; and a processor in communications with the memory, wherein the computer system is configured to perform a method, said method comprising:

automatically determining content to be included in an audible representation of data content to be generated for a particular user, the automatically determining including automatically selecting the content for the particular user based on a history of content preferences for the particular user and not based on content preferences of other users;

generating the audible representation for the particular user using the selected content, wherein a custom-content audible representation is generated for the particular user; and determining a custom-length for the audible representation, wherein the generating comprises tailoring the audible representation to the custom-length, wherein determining the custom-length comprises automatically determining the custom-length for the audible representation and wherein the automatically determining the custom-length comprises determining the custom-length based on a travel time for the particular user.

9. The computer system of claim 8, wherein the history of content preferences comprises one or more browser histories of the particular user.

10. The computer system of claim 8, wherein the automatically determining content to be included in the audible representation comprises prioritizing the selected content, and initially choosing content of a highest priority to be included in the audible representation.

11. The computer system of claim 8, wherein the generating comprises removing redundant content in generating the audible representation.

12. The computer system of claim 8, wherein the method further comprises:

automatically determining one or more changes to be made to the audible representation; and regenerating the audible representation to reflect the one or more changes.

13. A method of generating audible representations of data content, said method comprising:

automatically determining, by a processor, content to be included in an audible representation of data content to be generated for a particular user, the automatically determining including automatically selecting the content for the particular user based on a history of content preferences for the particular user and not based on content preferences of other users;

generating the audible representation for the particular user using the selected content, wherein a custom-content audible representation is generated for the particular user; and determining a custom-length for the audible representation, wherein the generating comprises tailoring the audible representation to the custom-length, wherein determining the custom-length comprises automatically determining the custom-length for the audible representation and wherein the automatically determining the custom-length comprises determining the custom-length based on a travel time for the particular user.

14. The method of claim 13, further comprising:

automatically determining one or more changes to be made to the audible representation; and regenerating the audible representation to reflect the one or more changes.

* * * * *